United States Patent [19]

Kaut

[11] 4,419,938

[45] Dec. 13, 1983

[54] PLUG-ASSEMBLED SECTIONAL DISPLAY RACK

[76] Inventor: Albin Kaut, Blankensteinstrasse 26, D-7141 Steinheim/Murr, Fed. Rep. of Germany

[21] Appl. No.: 327,479

[22] Filed: Dec. 4, 1981

[30] Foreign Application Priority Data

Dec. 6, 1980 [DE] Fed. Rep. of Germany ..... 3046139

[51] Int. Cl.[3] ..... A47B 3/00

[52] U.S. Cl. ..... 108/111; 108/101; 211/182; 312/140

[58] Field of Search ..... 108/111, 101, 153, 92; 403/231, 403; 248/188; 211/182, 183; 312/140, 111, 257 SK

[56] References Cited

U.S. PATENT DOCUMENTS

| | | | |
|---|---|---|---|
| 2,904,360 | 9/1959 | Gamlen | 312/140 X |
| 3,670,899 | 6/1972 | Kronenberg | 211/182 |
| 3,747,885 | 7/1973 | Storaciancimino | 211/182 X |
| 3,851,601 | 12/1974 | Davis | 108/153 |
| 4,094,417 | 6/1978 | Cairnes et al. | 108/111 X |
| 4,145,977 | 3/1979 | Yellin | 108/111 |
| 4,242,969 | 1/1981 | Checkwood | 108/111 X |
| 4,301,636 | 11/1981 | Luria | 312/140 X |

FOREIGN PATENT DOCUMENTS

| | | | |
|---|---|---|---|
| 593768 | 5/1959 | Italy | 108/111 |
| 1011688 | 12/1965 | United Kingdom | 108/153 |

*Primary Examiner*—William E. Lyddane
*Assistant Examiner*—A. Aschenbrenn
*Attorney, Agent, or Firm*—Harding, Earley, Follmer & Frailey

[57] ABSTRACT

A plug-assembled multi-shelf sectional display rack constituted of a plurality of horizontal and vertical hollow sections joined together at their ends by corner junctions having vertically and horizontally extending plugs engageable within the hollows of the sections. Each section is provided with a longitudinally extending inwardly facing recess which merges into a hollow longitudinal guide extending axially of the section. Mounted within the recesses and guides of the vertical sections are inwardly extending supports having horizontal surfaces for holding shelves. The supports determine the vertical spacing between the shelves. They include guide sections engageable within the hollow axially extending guides of the sections. Vertical gaps are provided between lateral faces formed on the supports and the walls defining the recesses of the vertical sections to permit insertion of vertical panels.

10 Claims, 12 Drawing Figures

Figure 1:
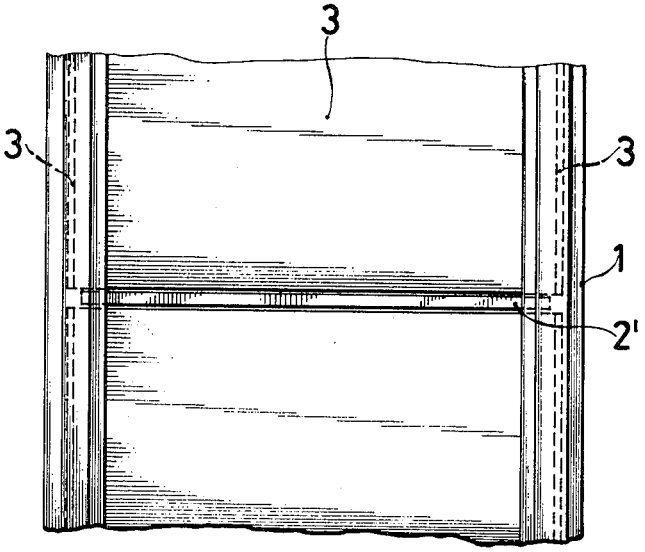

FIG. 7
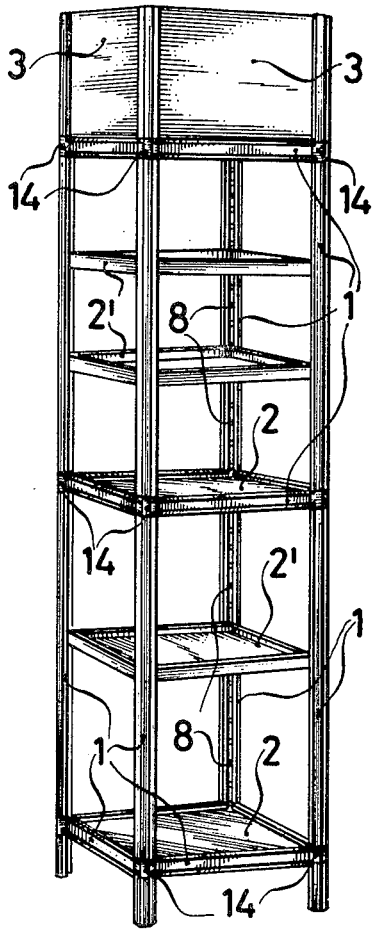
FIG. 10
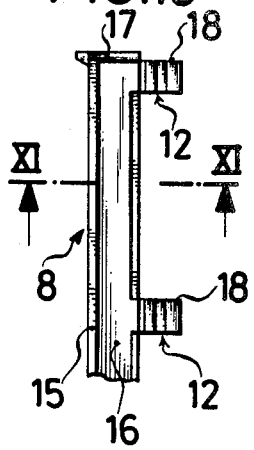
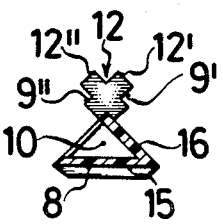
FIG. 11
FIG. 8
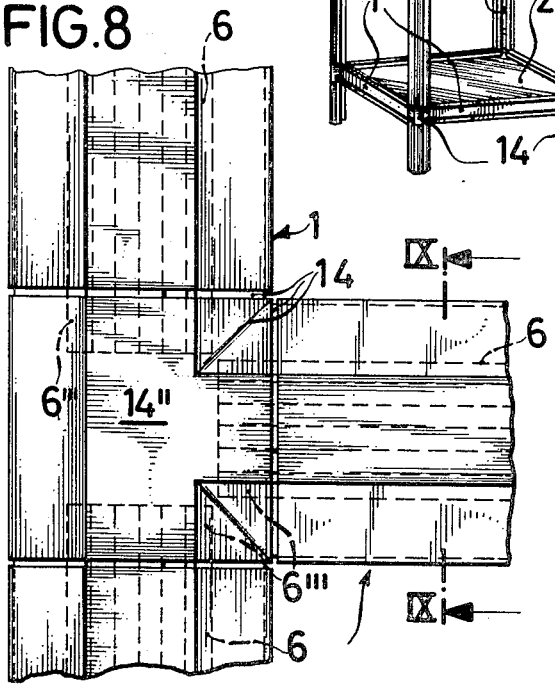
FIG. 9
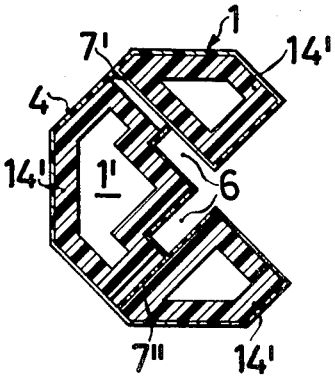

PLUG-ASSEMBLED SECTIONAL DISPLAY RACK

FIELD OF THE INVENTION

The invention relates to a plug-assembled multi-shelf sectional rack suitable for display purposes, as a selling aid, for store decoration as well as for exhibition stands, etc. The rack comprises hollow sections arranged vertically and horizontally so as to form, by means of corner junctions having plug connections, frames adapted to receive shelves for exhibiting items and/or vertical panels for providing multilateral individual display cases within the rack, each of said hollow sections including a 90 degree recess as well as a longitudinal guide opening thereto for the attachment of said shelves and of said vertical panels.

BACKGROUND OF THE INVENTION

From German utility model No. 79 14 940, a plug-assembly rack of the type mentioned above has been known, wherein each of a plurality of hollow sections includes a 90 degree recess with a longitudinal guide that opens thereto. In order to support the individual shelves on this conventional rack, it is necessary to arrange horizontally between the respective vertical hollow sections at least two hollow sections parallel to each other. For joining the latter to the vertical hollow sections, special functions are required. Consequently, the vertical hollow sections have to be made of several parts, and the horizontal hollow sections constitute optical distractions in the complete rack structure, especially where the shelves have to be of glass, as is rather frequently the case with plug-assembly racks of the type mentioned which are to be used for display and decoration purposes. Further, vertical panels can at best be inserted in grooves open to the recesses of the conventional hollow sections. Since these grooves can naturally be but narrow, the range of thicknesses of the panels used is restricted in a very undesirable way.

OBJECTS OF THE INVENTION

It is an object of the invention to improve plug-assembly racks by creating a simplified structure of a more uniform look.

Another object of the invention consists in providing most simple ways and means for attaching shelves, in particular glass shelves, and wall panels.

It is a further object of the invention to enable the convenient attachment of shelves and panels having a wide range of wall thicknesses.

SUMMARY OF THE INVENTION

In accordance with the invention, these objects are attained by the improvement wherein supports are provided with base portions having guide sections for introduction into said longitudinal guides of such hollow sections so that support portions extend into said recesses, said base portions comprising upper faces serving as beds for said shelves and comprising lateral faces either for attaching vertical panels or, if inserted into horizontal hollow sections, for attaching shelves. In particular, each base portion is shaped such that there are gaps between its lateral faces and the walls of said recesses (90 degree notches), thus permitting insertion of vertical panels or shelves.

Important advantages of the plug-assembly rack according to the invention include the fact that both the shelves and the wall panels are securely held by the novel supports only and that their mounting is most convenient. For any viewer, the supports will be well-nigh invisible as they are hidden behind the plug-assembly hollow sections. Therefore, the overall aspect of the plug-assembly rack for decoration purposes is not affected at all. Essentially, only the front sides of the hollow sections and of the junctions can be seen, but these front sides can be attractively designed, whereas the means for supporting the shelves and even the panels remain invisible. It is possible to use hollow sections of any profile so that they offer to the viewer faces of a more or less edgy and/or rounded nature that are possibly suited, in addition, for the presentation of advertisements or for designating individual items displayed in the rack. The design and arrangement of the supports is very simple so that they lend themselves to quick and precise manufacture. The entire rack can be assembled with effortless ease, no matter how many shelves and panels are to be mounted and no matter what the desired spacings are to be. Even where individual show cases or all of the display cages formed are completely closed, any items to be displayed can conveniently be put into the rack or be exchanged therein. It will be realized that the plug-assembly rack according to the invention provides for a simple structure that is easily handled and of a very attractive external appearance.

Further features and advantages of the invention are disclosed and elucidated hereinafter with reference to special embodiments shown in the drawings.

Figure 2:
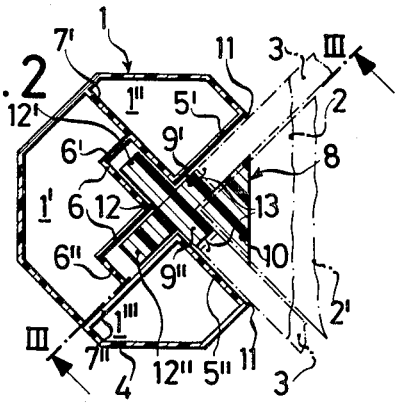
Figure 3:
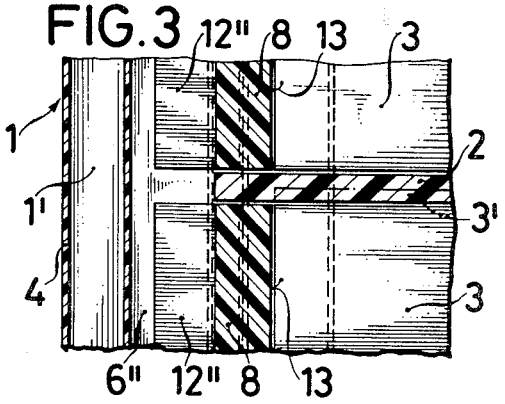
Figure 4:
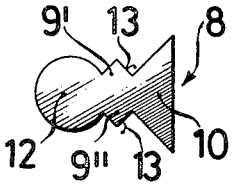
Figure 12:
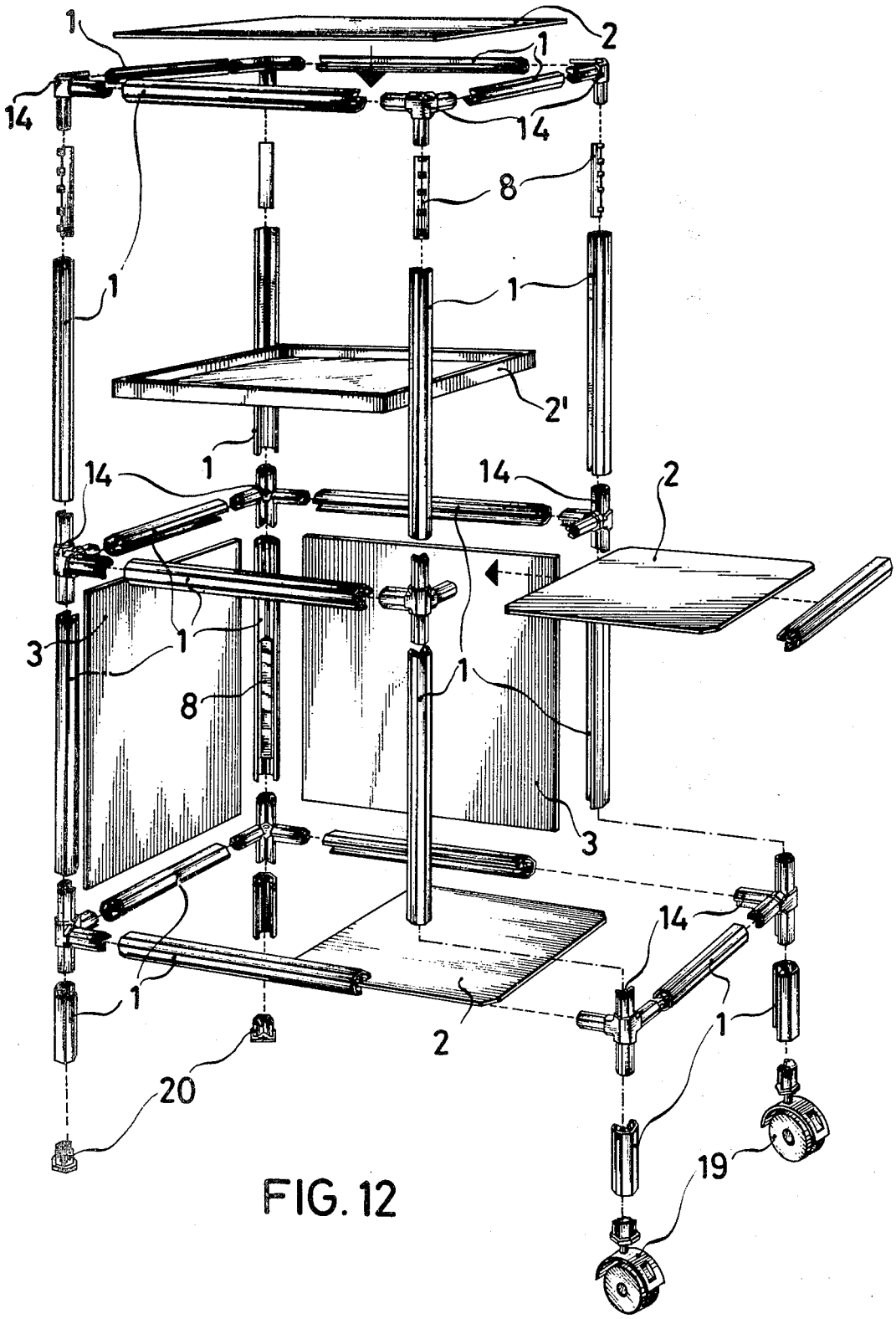

In the annexed drawings:

FIG. 1 shows a partial front elevation of a plug-assembly rack according to the invention, FIG. 2 is a horizontal cross sectional view across a hollow section of a rack, FIG. 3 is a section along the line III—III in FIG. 2, FIGS. 4 to 6 show front elevations of various supports, FIG. 7 is a perspective view of an assembled rack, FIG. 8 shows a front elevation of a junction, FIG. 9 is a cross sectional view along line IX—IX in FIG. 8, FIG. 10 shows a side elevation of a support, FIG. 11 is a cross sectional view along line XI—XI in FIG. 10 and FIG. 12 is an exploded perspective view of a rack according to the invention, indicating its variegated ways of assembly and combination.

DESCRIPTION

Referring to FIGS. 1 and 12, a plug-assembly rack according to the invention comprises hollow sections 1 arranged vertically and horizontally and joined to each other as customary at their ends. Horizontal shelves 2 and vertical side panels 3 are attached to and between the hollow sections 1 so that a number of (one or more) display cases or show cages are formed therebetween.

The hollow section 1 according to FIG. 2 is octogonal with a peripheral wall 4 one side of which is shaped such that a longitudinal recess or notch of 90° angular cross-section is formed having walls 5' and 5''. A hollow longitudinal guide 6 which is provided axially in the hollow section 1 merges into this recess. In the embodiment shown, longitudinal guide 6 is composed of two hollow guide channels 6' and 6'' that are arranged at a right angle to each other and that meet in an open space at the center of hollow section 1. Bifurcated channels 6' and 6'' are reinforced by stiffening panels 7' and 7", respectively, which are joined to the wall 4 of hollow section 1 so as to provide therein a plurality of ducts 1',1", 1'" that are parallel to each other.

In longitudinal guide 6, there is inserted a linear shelf support 8 of a length spanning the spacing between two adjacent shelves 2 so as to support them at the locations provided thereby. Support 8 is held in longitudinal guide 6 by means of a guide element 12 which, in this embodiment, comprises two arms 12' and 12" arranged at a right angle to each other and extending into the channels 6' and 6", respectively. Guide edges 9' and 9" formed on arms 12' and 12", respectively, are disposed in the recess of hollow section 1 so as to engage the outside of recess walls 5' and 5", respectively, thus stabilizing support 8. Disposed between the two guide edges 9' and 9" is a base portion 10, the upper face of which serves as a support surface for shelf 2. Slots 11 provided between the lateral faces of base portion 10 and recess walls 5' and 5", respectively, permit inserting a side panel 3 or a shelf 2, as the case may be; this is illustrated well in FIG. 12. At their rear ends, slots 11 are closed by retangular faces 13 of guide edges 9' and 9".

Referring now to shelf 2, it may be formed to seal flush with side panels 3, i.e. to extend into the clearance between two superimposed side panels as indicated in FIGS. 2 and 3. Alternatively, shelf 2 may be dimensioned so as to terminate at the inner faces of side panels 3, as is shown by broken lines 2' in FIG. 2, and in this case, the superimposed side panels 3 are contiguous, as will be seen from butt line 3' indicated in FIG. 3.

Figure 5:
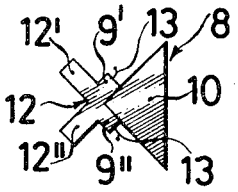
Figure 6:
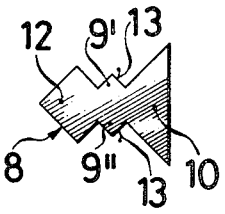

Guide element 12 of support 8 may include bifurcated arms 12' and 12" as has been described and as is shown in FIG. 5. However, guide element 12 may be shaped differently, e.g. as a circular or near-circular element according to FIG. 4, as a rectangular element according to FIG. 6 or with any other suitable cross-section that will provide positive axial engagement within hollow sections 1 for secure support of shelves 2 and side panels 3.

A plurality of hollow ssections 1 some of which extend vertically and some of which extend horizontally may be plug-assembled, by means of corner junctions 14, to form a display rack for example as shown in FIGS. 7 and 12. For this purpose, junctions 14 are provided with two or more plug inserts 14' arranged opposite and/or at right angles to each other (FIGS. 9, 12).

Insert portions 14' also are formed as hollow sections having separate axial plug sections. The number of the latter corresponds to the number of ducts 1', 1", 1'" defined by stiffening panels 7', 7" in hollow section 1. Also, these axial plug sections of inserts 14' complement the inner cross-sectional configurations of the longitudinal ducts 1', 1", 1'" of hollow section 1 such that, by inserting them therein (FIG. 9), a stable braced structure is formed. The core 14" (FIG. 8) of junction 14 is enlarged outwardly by the amount of the thickness of wall 14 of hollow section 1, relative to insert portions 14'. This provides for smooth transitions between the hollow sections 1', as will be evident particularly from FIG. 8.

Support 8 can be made of solid material. However, it may alternatively be made as a hollow section (cf. FIGS. 10 and 11) in order to economize with respect to both material and weight, without sacrificing strength. In such embodiment, base portion 10 forms an open angular element composed of a base wall 15 and a side wall 16 forming an acute angle thereto, which walls are reinforced at their upper edges by end walls 17 serving as support surfaces for shelves 2. Guide element 12 comprises a plurality of short profiled pieces 18 spaced along the leading edge of side wall 16. These profiled pieces 18 include bifurcated arms 12' and 12" as well as guide edges 9' and 9", respectively, and are designed to be inserted into the bifurcated longitudinal guide 6 of hollow section 1. In order to be able to position support 8 close to the respective assemblage point of junction 14, longitudinal guide 6 of hollow section 1 is provided with extensions 6'" (FIG. 8) projecting into core 14" of junction 14.

It is also possible to shape support 8 for carrying shelves 2 only. Thus rectangular faces 13 can be dispensed with, and the longitudinal guide edges 9' and 9" may extend along recess walls 5' and 5", respectively, bridging slots 11 as shown by chain-dot lines in FIG. 2.

As has been mentioned, FIG. 12 shows an exploded perspective view to illustrate various combinations and various ways of assembly of a rack according to the invention, some assembly steps being indicated by arrows. No further description will be required inasmuch as the same reference numerals are used in FIG. 12 as in FIGS. 1 to 11 for like parts. However, it is shown in addition that at the lower ends of the four vertical columns hollow sections 1 forming the rack depicted, either casters 19 or resilient feet 20 may be inserted. While the former will allow the rack to be moved easily, the latter will both insure stability and prevent side-slipping of the rack.

The lengths between supports 8 determine the spacing of adjacent shelves 2 of the rack. It is possible to supply supports 8 of considerable lengths ex works to the site and to cut them to the size required for a particular rack. Such arrangement which is facilitated if the supports are made of a plastic material. Another supply mode provides for the individual support lengths to match the standard spacing between adjacent shelves. Further, supports 8 of one or more predetermined standard length(s) may be manufactured and supplied to the site where the spacing of adjacent shelves can be modified suitably, e.g. by inserting a number of adapter pieces the lengths of which may be uniform or non-uniform and may have modular dimensions. It will be realized that such adapters joined to each other are functionally equivalent to a single integral support.

While preferred embodiments have been illustrated and elucidated hereinabove, it should be understood that numerous variations and modifications will be apparent to one skilled in the art without departing from the principles of the invention which, therefore is not to be construed to be limited to the specific forms described.

I claim:

1. In a plug-assembled sectional rack suitable for display purposes and for use as a selling aid, store decoration, exhibition stand and the like, having hollow sections arranged vertically and horizontally to form, by means of corner junctions having plug connections, frames adapted to receive shelves for exhibiting items and/or vertical panels for multilaterally confining individual display cases within the rack, each of said hollow sections including a longitudinal recess defined by angular walls and a hollow longitudinal guide merging with the recess for accommodating said shelves and said vertical panels, the improvement comprising shelf supports having base portions provided with guide elements for insertion into said hollow longitudinal guides of the hollow sections whereby said shelf supports extend into said recesses, said base portions having upper faces serving as support surfaces for said shelves and having lateral faces for engaging said vertical panels, each said shelf support base portion being shaped such that there are slots between its lateral faces and the walls of said recesses for insertion of the vertical panels.

2. Rack according to claim 1, wherein the shelves are inserted into horizontal hollow sections, characterized in that the base portions of said shelf supports have lateral faces engaging the shelves and the slots between the lateral faces and the walls of said recesses receive and support the shelves.

3. Rack according to claim 1 or claim 2, wherein said slots have rear ends and said shelf supports have guide edges located adjacent its said guide elements, each said guide edge engaging an adjacent recess wall and having a rectangular face which defines the rear end of one of said slots.

4. Rack according to claim 3, wherein said hollow longitudinal guide in each of said hollow sections comprises bifurcated guide channels adapted to receive bifurcated arms comprising the guide elements of said shelf supports.

5. Rack according to claim 3, wherein said hollow longitudinal guide in each of said hollow sections includes at least one stiffening panel connected to the wall of the hollow section so as to form therein a plurality of longitudinal ducts that are parallel to each other and are adapted to receive complemental plug insert portions formed on said corner junctions.

6. Rack according to claim 5, wherein said plug insert portions of said corner junctions are made of hollow section material.

7. Rack according to claim 5, wherein said plug insert portions of said corner junctions have inner ends reduced externally by the wall thickness of said hollow sections, and wherein a reinforced core portion of each of said junctions is adapted to receive extensions of said hollow longitudinal guides formed in said hollow sections.

8. Rack according to claim 3, wherein said shelf supports are made of hollow sections having a base wall and a side wall forming an acute angle to said base wall, and wherein said shelf support guide elements comprise a plurality of spaced profiled sections attached to the leading edge of said side wall.

9. Rack according to claim 3, wherein the length of said shelf supports determines the spacing of adjacent shelves.

10. Rack according to claim 3, wherein said shelf supports are of one or more predetermined standard lengths, and wherein, by inserting one or more adapter pieces of either uniform or non-uniform lengths, the spacing of adjacent shelves is adjustable to selected modular dimensions.

* * * * *

UNITED STATES PATENT AND TRADEMARK OFFICE

CERTIFICATE OF CORRECTION

PATENT NO. : 4,419,938

DATED : December 13, 1983

INVENTOR(S) : Albin Kaut

It is certified that error appears in the above-identified patent and that said Letters Patent is hereby corrected as shown below:

Column 1, line 28, "functions" should read -- junctions --

Column 4, line 26, after "umns" insert -- of --

Column 4, line 35, delete "which"

Signed and Sealed this

*Ninth* Day of *October 1984*

[SEAL]

*Attest:*

GERALD J. MOSSINGHOFF

*Attesting Officer*

*Commissioner of Patents and Trademarks*